US007466941B2

(12) United States Patent
Miyamura

(10) Patent No.: US 7,466,941 B2
(45) Date of Patent: Dec. 16, 2008

(54) DRIVE DEVICE USED IN IMAGE FORMING DEVICE

(75) Inventor: Hiroaki Miyamura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 124 days.

(21) Appl. No.: 11/642,587

(22) Filed: Dec. 21, 2006

(65) Prior Publication Data

US 2007/0140726 A1 Jun. 21, 2007

(30) Foreign Application Priority Data

Dec. 21, 2005 (JP) ..... 2005-368479

(51) Int. Cl.
*G03G 15/00* (2006.01)
*G03G 21/20* (2006.01)

(52) U.S. Cl. ..... 399/167; 399/44; 399/94

(58) Field of Classification Search ..... 399/44, 399/94, 167; 310/75 R, 83
See application file for complete search history.

(56) References Cited

U.S. PATENT DOCUMENTS 6,420,807 B1 * 7/2002 Tsujimoto et al. ..... 310/83
6,768,235 B2 * 7/2004 Tsujimoto et al. ..... 310/75 R
7,121,205 B2 * 10/2006 Ono et al. ..... 399/167 X
7,177,571 B2 * 2/2007 Sato et al. ..... 399/167

FOREIGN PATENT DOCUMENTS

JP 2002-171779 6/2002

* cited by examiner

*Primary Examiner*—Sandra L Brase
(74) *Attorney, Agent, or Firm*—Global IP Counselors, LLP

(57) ABSTRACT

A drive device 1 includes a planetary roller type power transmission unit, a temperature sensor 5*b*, a delay time determination unit 103, and an image processing control unit 104. The planetary roller type power transmission unit includes a plurality of planetary rollers at least a part thereof made from an elastic material that is pressed against the periphery of a motor 2 rotation shaft, a ring that contacts the plurality of planetary rollers, a carrier roller, and an output shaft. The temperature sensor 5*b* measures the temperature Te of or near the planetary roller. The delay time determination unit 103 determines the delay time Td from the start up time of the motor 2 until the start of the image forming process. The image processing control unit 104 starts the image forming process after the delay time Td has passed from the start up time of the motor 2.

12 Claims, 7 Drawing Sheets

DELAY TIME CONDITIONS TABLE

101a

| TEMPERATURE RANGE (°C) (Te; TEMPERATURE FROM TEMPERATURE SENSOR 5b) | CONDITIONS FOR DETERMINING THE DELAY TIME Td (sec) |
|---|---|
| Te<0 | Td=22 |
| 0≦Te<20 | Td=10+(20−Te)/2.89 |
| 20≦Te | Td=10 |

Fig. 5

DRIVE DEVICE USED IN IMAGE FORMING DEVICE

CROSS-REFERENCE TO RELATED APPLICATIONS

This application claims priority to Japanese Patent Application No. 2005-368479 filed on Dec. 21, 2005. The entire disclosure of Japanese Patent Application No. 2005-368479 is hereby incorporated herein by reference.

BACKGROUND OF THE INVENTION

1. Field of the Invention

The present invention generally relates to a drive device. More specifically, the present invention relates to a drive device used in an image forming device.

2. Background Information

Image forming devices such as color printers, color copiers, and the like, have rotation drive devices to rotate and to drive an image forming unit, e.g. photosensitive drums for each color component, transfer belts, and so on. Some rotation drive devices include a motor and a planetary speed reduction device to reduce the speed of the motor.

In recent years, with the reduction in cost of image forming devices there is a tendency to form at least part of the planetary roller in the planetary speed reduction device using an elastic material such as, for example, rubber. Elastic deformations are produced in planetary rollers made from an elastic material because the planetary rollers are pressed against the output shaft to transmit the rotation of a motor to the outside. The elastic deformations of the elastic material of the planetary roller cause a change in the rotation speed of the output shaft of the speed reduction device. Furthermore, color distortion, color unevenness, and the like appears in the images produced when the rotation speed of the output shaft of the speed reduction device fluctuates.

In Japanese Patent Application Laid-open No. 2002-171779, a rotation drive device is disclosed in which when an elastic material is used in the planetary roller, the rotation speed of the motor is directly controlled to obtain a uniform rotation speed of the output shaft. Specifically, the rotation drive device of Japanese Patent Application Laid-open No. 2002-171779 includes a stepping motor, an elastic material speed reduction device, and a feedback control unit. The elastic material speed reduction device includes a torque transmission unit that transmits torque by frictional contact of the elastic material, and does not include a torque transmission unit that uses gears. The elastic material speed reduction device reduces the rotation speed of the motor and outputs the rotation speed to the photosensitive drum. The feedback control unit measures the output rotation speed of the elastic material speed reduction device, obtains the difference from the standard speed, and applies a speed command signal to the motor based on the value of the difference so that the rotation speed of the motor is directly controlled.

However, the device of Japanese Patent Application Laid-open No. 2002-171779 has the following problem points.

The elastic deformation occurs in the elastic material of the planetary roller during the time that motor rotation has stopped until the motor is driven again. This deformation causes non-uniformity in the rotation speed of the output shaft of the speed reduction device for a while after starting to drive again. The period of time that the rotation speed of the output shaft of the speed reduction device is non-uniform as a result of elastic deformation induced in the planetary roller when the motor is stopped is much longer than the response time of the feedback control of the device in Japanese Patent Application Laid-open No. 2002-171779. Therefore, detecting non-uniformity of the rotation speed of the output shaft of the speed reduction device caused by elastic deformation of the planetary roller when the motor is stopped and controlling the rotation speed by the feedback control of the device of Japanese Patent Application Laid-open No. 2002-171779 will result in over-control.

Further, the time required until the elastic deformation in the elastic material of the planetary roller recovers as a result of the rotation of the motor depends on the temperature of the planetary roller. For example, if the planetary roller is at a low temperature, the time required until the elastic deformation of the planetary roller recovers becomes longer. The temperature of the planetary roller varies depending on the environment in which the color image forming device is used.

In view of the above, it will be apparent to those skilled in the art from this disclosure that there exists a need for an improved a drive device used in an image forming device. This invention addresses this need in the art as well as other needs, which will become apparent to those skilled in the art from this disclosure.

SUMMARY OF THE INVENTION

Therefore, it is an object of the present invention to provide a drive device that prevents images from being affected by non-uniformity in the rotation speed of the output shaft of the speed reduction device caused by elastic deformation of the planetary roller. The present invention provides a drive device that prevents elastic deformation of the planetary roller from affecting the images, regardless of the temperature of the elastic material of the planetary roller.

To realize this object, a drive device 1 according to a first aspect of the present invention includes a planetary roller type power transmission unit, a measurement unit, a delay time determination unit, and an image processing control unit. The planetary roller type power transmission unit includes a plurality of planetary rollers at least a part thereof made from an elastic material that is pressed against the periphery of a motor rotation shaft, a ring that contacts the plurality of planetary rollers on the internal surface of the ring, a carrier roller that rotates in conjunction with the rotation of the planetary rollers, and an output shaft that outputs the rotation of the carrier roller to the outside. The measurement unit measures the temperature of the planetary roller or the temperature near the planetary roller. The delay time determination unit determines the delay time from the start up time of the motor until the start of the image forming process. The image processing control unit starts the image forming process after the delay time has passed from the start up time of the motor.

While the motor is stopped, elastic deformation occurs in the part of the planetary rollers made from an elastic material. The time required for the elastic deformation to recover depends on the temperature of the elastic material in the planetary rollers. This device determines the timing for the start of the image forming process based on the measured temperature. In this way the elastic deformation occurring in the elastic material of the planetary rollers while the motor is stopped recovers during the time from start up of the motor until the start of the image forming process. Therefore, the rotation speed of the output shaft is constant. Therefore, it is possible to prevent phenomena such as color distortion and color unevenness on images as a result of non-uniformity of the rotation speed of the output shaft.

A drive device according to a second aspect of the present invention is the device of the first aspect, further including a recording unit that records a plurality of temperature ranges and their corresponding conditions that determines the delay time. The delay time determination unit determines the temperature range from among the plurality of temperature ranges in the recording unit that corresponds to the temperature measured by the measurement unit. The delay time determination unit determines the delay time in accordance with the conditions corresponding to the applicable temperature range.

This device records the temperature ranges of the planetary rollers and the corresponding conditions. Therefore, the delay time is determined corresponding to the temperature of the planetary rollers or the temperature near the planetary rollers. In this way, even though the time for recovery of the elastic deformation varies as the temperature of the planetary rollers varies, it is possible to start the image forming process after the elastic deformation has recovered.

According to the present invention, it is possible to prevent the images from being affected by unevenness of the rotation speed of the output shaft of the speed reduction device caused by elastic deformation of the planetary rollers. Also, according to the present invention, it is possible to prevent elastic deformation of the planetary rollers from affecting the images, regardless of the temperature of the elastic material of the planetary rollers.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 5 is a view of a table of delay time conditions recorded in a recording unit of the drive control unit;

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
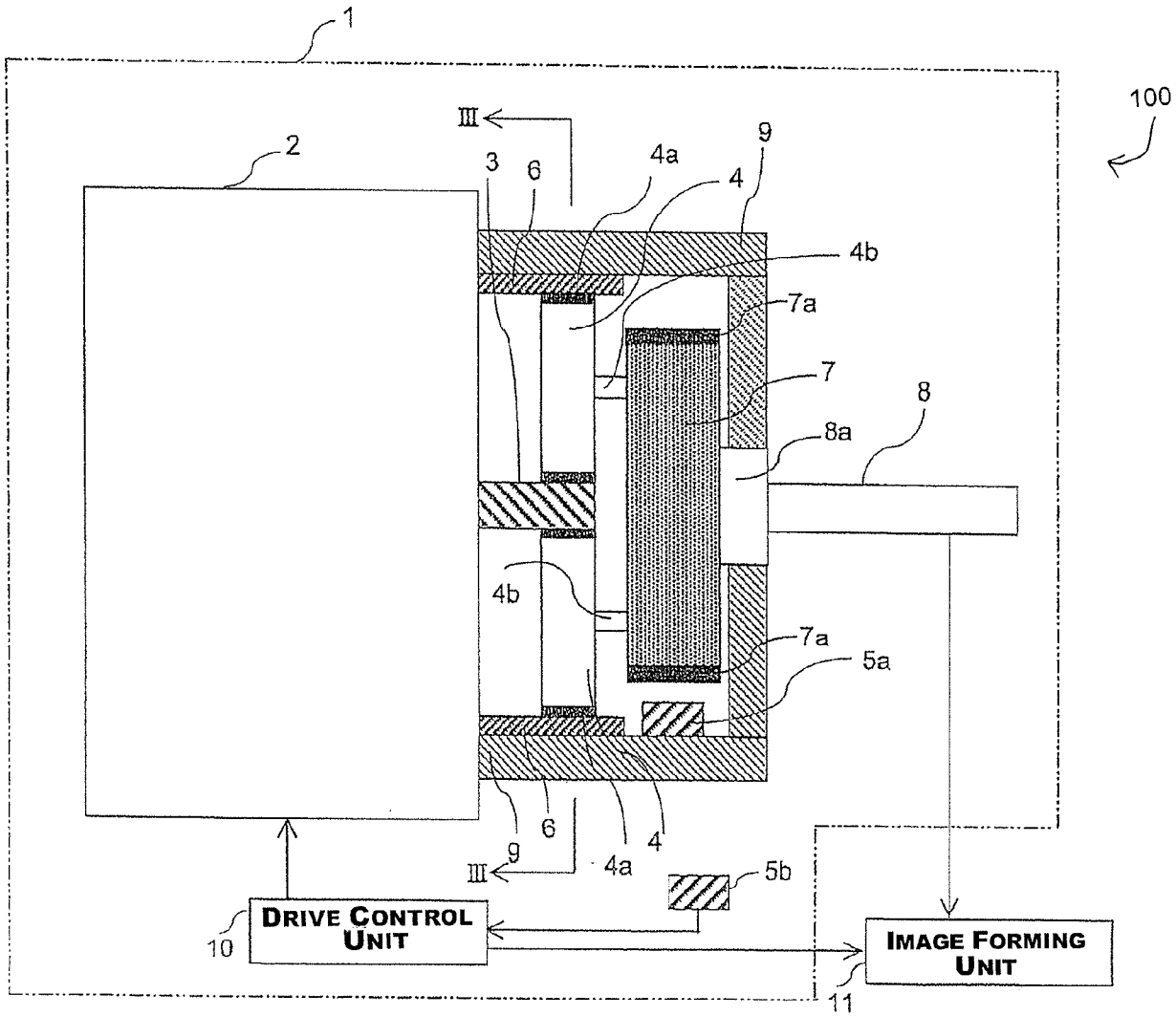
FIG. 1 is a schematic cross-sectional view of an image forming device showing the configuration of a drive device and connections with peripheral equipment according to a preferred embodiment of the present invention.

FIG. 1 is a schematic cross-sectional view of an image forming device showing a configuration of a drive device and the connections with peripheral equipment according to a first preferred embodiment of the present invention. The drive device 1 in FIG. 1 is a device connected to an image forming unit 11 to drive a photosensitive drum provided within the image forming unit 11. The image forming unit 11 is for example, a color image forming unit used in the image forming device 100 such as color printer, color copier, or the like.

Figure 2:
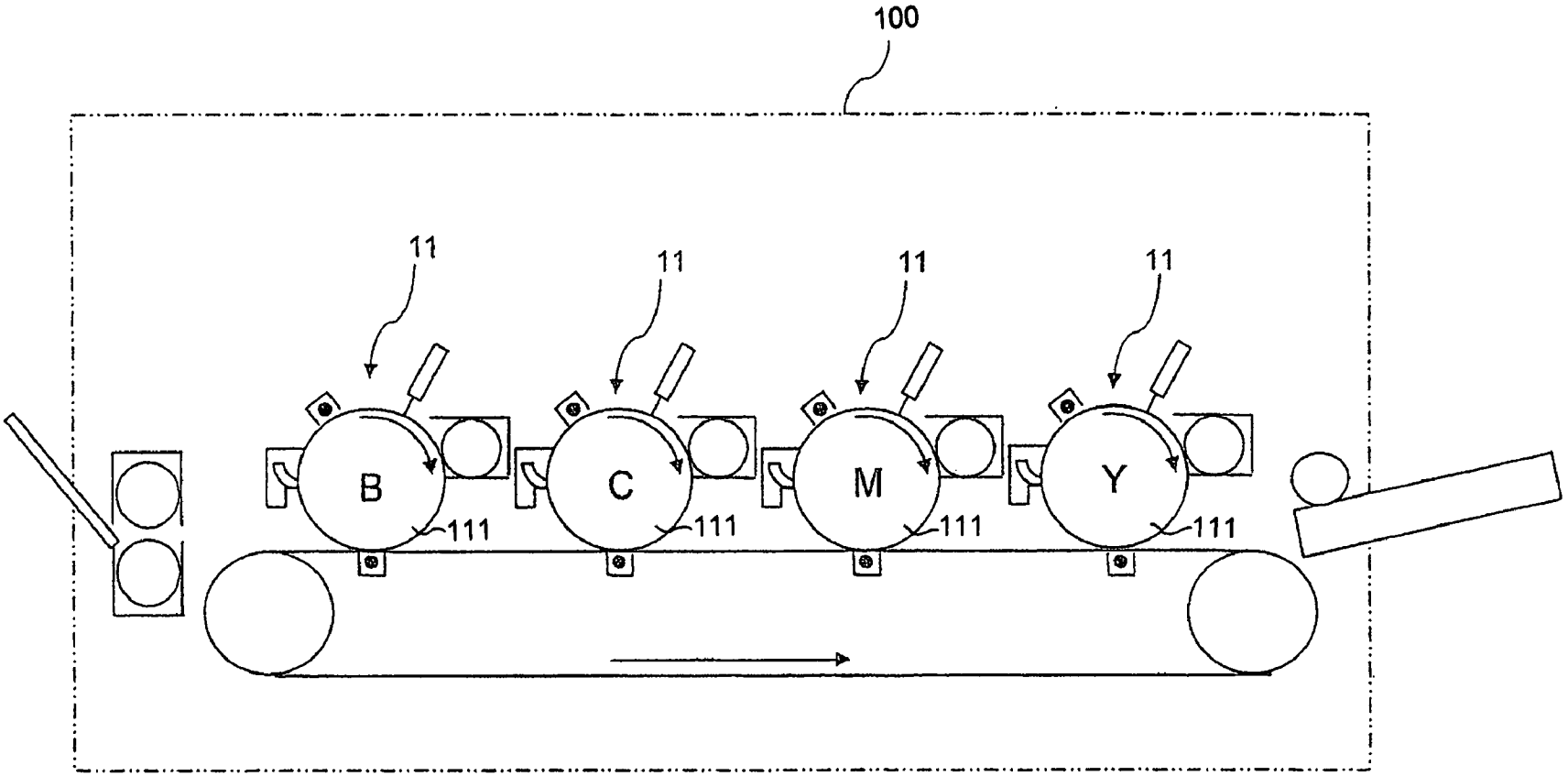
FIG. 2 is a schematic view of an image forming device having an image forming unit which is driven by the drive device according to the preferred embodiment of the present invention.

FIG. 2 is a schematic view of the image forming device 100. The image forming device 100 is a so-called tandem-type image forming device, in which four color unfixed visible images are multiply transferred onto a recording sheet, following which the image is fixed. The image forming device 100 includes image forming units for each color (Y, M, C, B), such as photosensitive drums 111 (image bearing bodies) disposed along the sheet transport route. A drive device 1 is provided for each photosensitive drum 111, so that each photosensitive drum 111 can be driven.

(1) Configuration of the Drive Device

Figure 3:
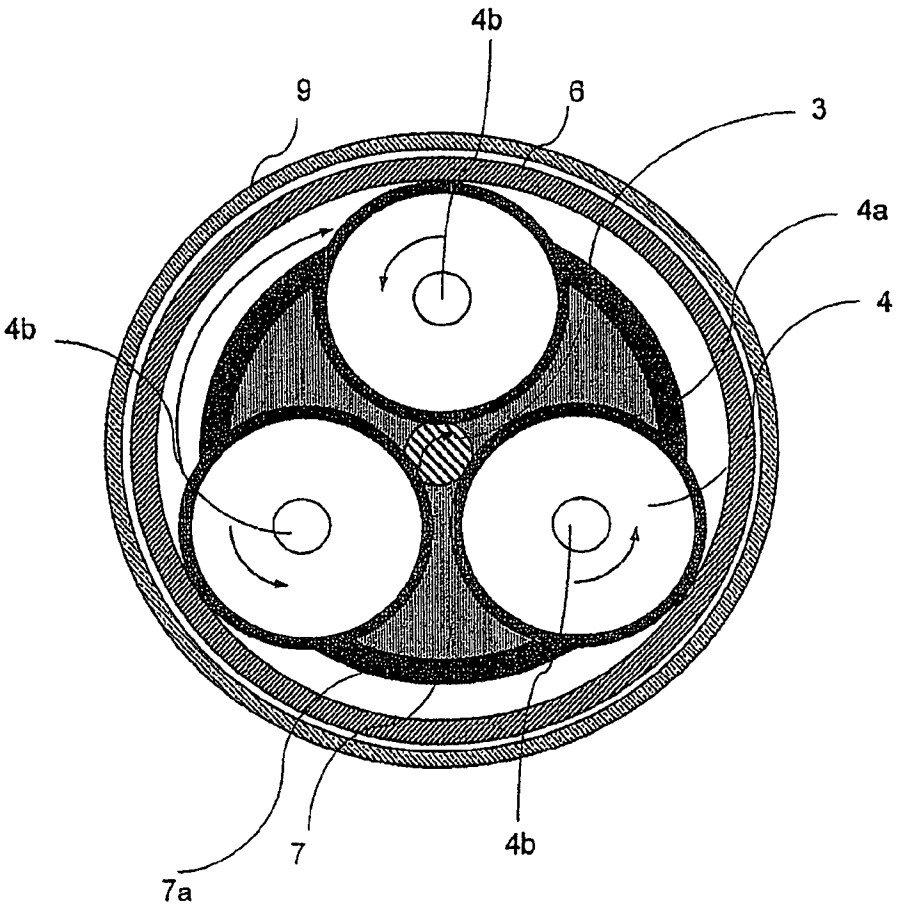
FIG. 3 is a sectional view at the line III-III of the drive device shown in FIG. 1.

FIG. 3 is a sectional view at the line III-III of the drive device shown in FIG. 1. The following is an explanation of the configuration of the drive device 1 using FIGS. 1 and 3.

The drive device 1 according to the present embodiment includes a motor 2, a motor rotation shaft 3, a plurality of planetary rollers 4, a rotation speed sensor 5*a*, a temperature sensor 5*b* (corresponding to the measurement unit), a ring 6, a carrier roller 7, an output shaft 8, a fixed body 9, and a drive control unit 10.

The motor 2 is configured to rotate the motor rotation shaft 3. The motor rotation shaft 3 outputs the rotation of the motor 2 to the outside to the planetary rollers 4. The plurality of planetary rollers 4 is disposed pressing against the external surface of the motor rotation shaft 3 and the internal surface of the ring 6 to rotate thereby and therein, respectively. The present embodiment is an example of the case where there are three planetary rollers 4. The edge of each planetary roller 4 is formed from an elastic material 4*a*. The elastic material can be, for example, rubber. The rotation speed sensor 5*a* is located on the internal surface of the fixed body 9, and measures the rotational speed of the carrier roller 7. The temperature sensor 5*b* is provided outside the motor 2 and the fixed body 9, near to the fixed body 9, and measures the temperature Te of the entire roller type power transmission unit that is described later. The ring 6 is positioned to enclose the three planetary rollers 4, and contacts the external surface of each planetary roller 4, preferably at the elastic material 4*a*. The carrier roller 7 is positioned on the side of the planetary rollers 4 opposite the motor 2, and is coupled to the planetary rollers 4 via rotation shafts 4*b* of the planetary rollers 4. Also, the carrier roller 7 is connected to the output shaft 8 via a bearing 8a positioned in a part of the fixed body 9. The edge of the carrier roller 7 is preferably made from a magnet 7*a*. The output shaft 8 is collinear with the motor rotation shaft 3, and outputs the rotation of the carrier shaft 7 to the outside, preferably to the image forming unit 11. The fixed body 9 is positioned outside the motor 2, and encloses the motor rotation shaft 3, the three planetary rollers 4, the rotation speed sensor 5a, the ring 6, and the carrier roller 7. In the following, the planetary rollers 4, the ring 6, the carrier roller 7, and the output shaft 8 are collectively referred to as the "planetary roller type power transmission unit."

The drive control unit 10 is preferably positioned outside the motor 2 and the fixed body 9, and is connected to the motor 2, the temperature sensor 5*b*, and the image forming unit 11. The configuration of the drive control unit 10 is described later.

(2) Operation of the Planetary Roller Type Power Transmission Unit and Motor Rotation Shaft Next, operation of the planetary roller type power transmission unit and motor rotation shaft 3 are explained using FIG. 3.

First, the motor rotation shaft 3 rotates in the rotation direction determined by the motor 2. Then the three planetary rollers 4 revolve around the motor rotation shaft 3 centered along the inner surface of the ring 6 in the same direction as the rotation direction of the motor rotation shaft 3. Furthermore, each planetary roller 4 rotates about the rotation axis of the respective planetary roller 4 in the opposite direction to the direction of rotation of the motor rotation shaft 3. The carrier roller 7 rotates in conjunction with the revolution of the planetary rollers 4. In other words, the carrier roller 7 rotates in the same direction as the rotation direction of the motor rotation shaft 3. At this time, the carrier roller 7 rotates with a rotation speed of the motor rotation shaft 3 reduced by the rotation of the planetary rollers 4.

(3) Configuration of the Drive Control Unit

Figure 4:
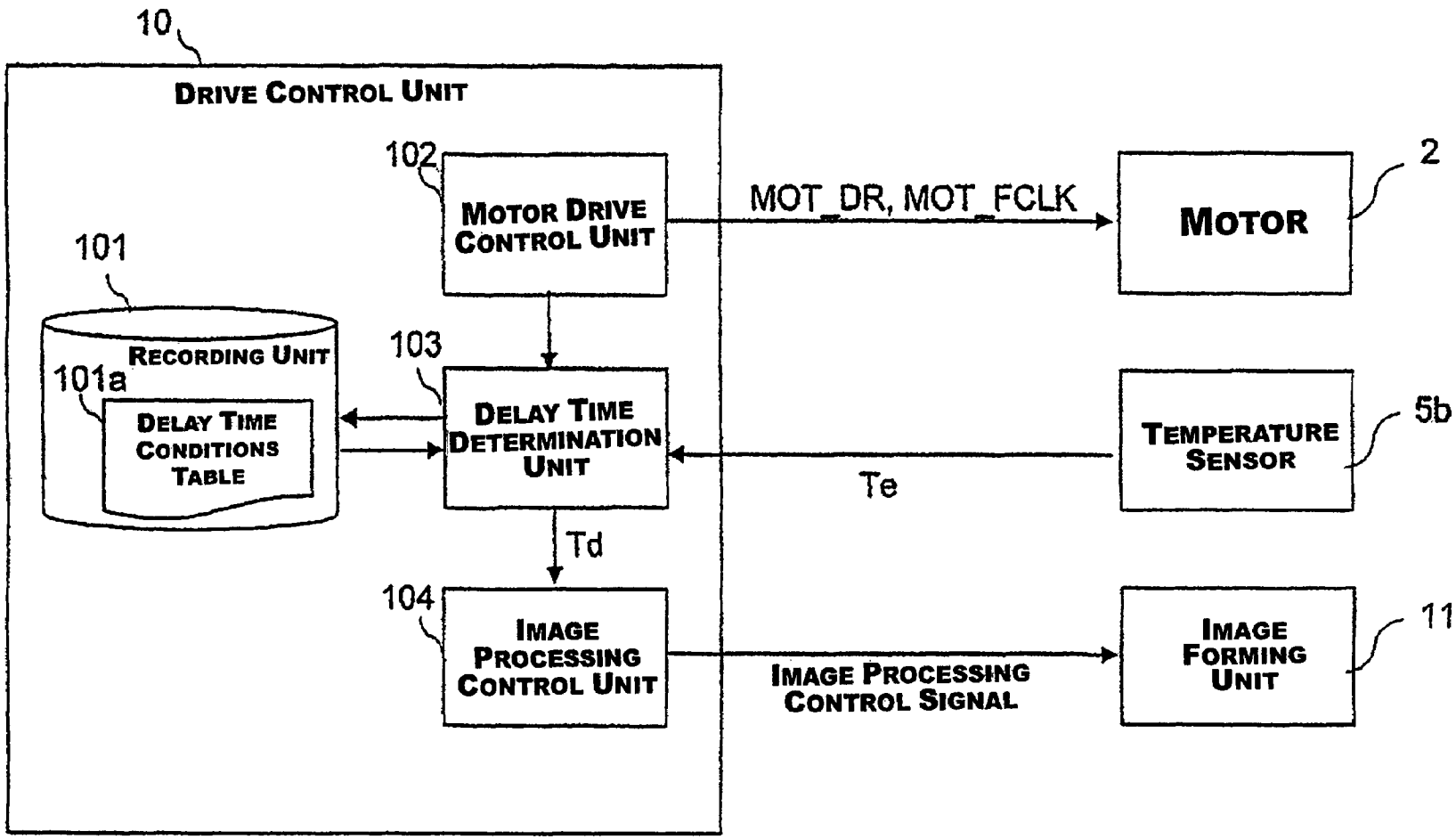
FIG. 4 is a diagrammatical view of the configuration of the function of a drive control unit of the drive device according to the preferred embodiment of the present invention.

Next, the configuration of the function of the drive control unit 10 according to the present embodiment is explained. FIG. 4 is a view of a diagram showing the configuration of the function of the drive control unit 10 according to the present embodiment. The drive control unit 10 includes a recording unit 101, a motor drive control unit 102, a delay time determination unit 103, and an image processing control unit 104.

(3-1) Recording Unit

FIG. 5 is a view of a diagram that explains the concept of a delay time conditions table recorded in the recording unit 101. The delay time conditions table 101*a* in FIG. 5 records the conditions that determine the temperature range and delay time Td as one record. The conditions that determine the delay time Td are the conditions that determine the delay time Td to be equal to or greater than the time required for the recovery of the elastic deformation of the elastic material 4*a* of the planetary rollers 4 when the motor was stopped.

For example, the temperature range $0 \leqq Te < 20$ and the corresponding conditions for determining the delay time Td "$Td=10+(20-Te)/2.89$" are recorded in the table. Here, 2.89 is a value associated with the type of fixing material used in a fixing device which is not shown in FIGS. 1 and 3.

The conditions that determine the delay time Td in FIG. 5 may be set based not only on the type of fixing material, but also based on the elastic modulus of the elastic material 4*a* in the planetary rollers 4. The elastic modulus of the elastic material 4*a* vary depending on the type of material.

(3-2) Motor Drive Control Unit

The motor drive control unit 102 controls the operation of the motor 2. For example, the motor drive control unit 102 transmits to the motor 2 a motor drive control signal MOT_DR to control the motor ON or OFF, or a motor rotation speed control signal MOT_FCLK to control the motor rotational speed. The detailed operation of the motor drive control unit 102 is described later.

(3-3) Delay Time Determination Unit

The delay time determination unit 103 determines the delay time Td from the time the motor 2 starts until the start of image processing based on the temperature Te measured by the temperature sensor 5*b*. Specifically, the delay time determination unit 103 determines which of the plurality of temperature ranges recorded in the delay time conditions table 101*a* in the recording unit 101 includes the temperature Te measured by the temperature sensor 5*b*. Then, the delay time determination unit 103 determines the delay time Td corresponding to the conditions corresponding to the temperature range applicable to the temperature Te. The delay time determination unit 103 transmits the determined delay time Td to the image processing control unit 104.

For example, assume the temperature sensor 5*b* measures the temperature Te to be 15° C. In this case the temperature Te=15° C. falls within the range $0 \leqq Te < 20$, so the delay time determination unit 103 calculates the delay time Td by entering "15" for "Te" in the condition "$Td=10+(20-Te)/2.89$" to determine the delay time Td.

(3-4) Image Processing Control Unit

The image processing control unit 104 receives the delay time Td determined by the delay time determination unit 103. The image processing control unit 104 controls the image forming unit 11 to start the image forming process after the delay time Td has passed since the motor 2 has started. Image forming processes include the color registration process, the calibration process, and other image forming correction processes. The detailed operation of the image processing control unit 104 is described later.

Figure 6:
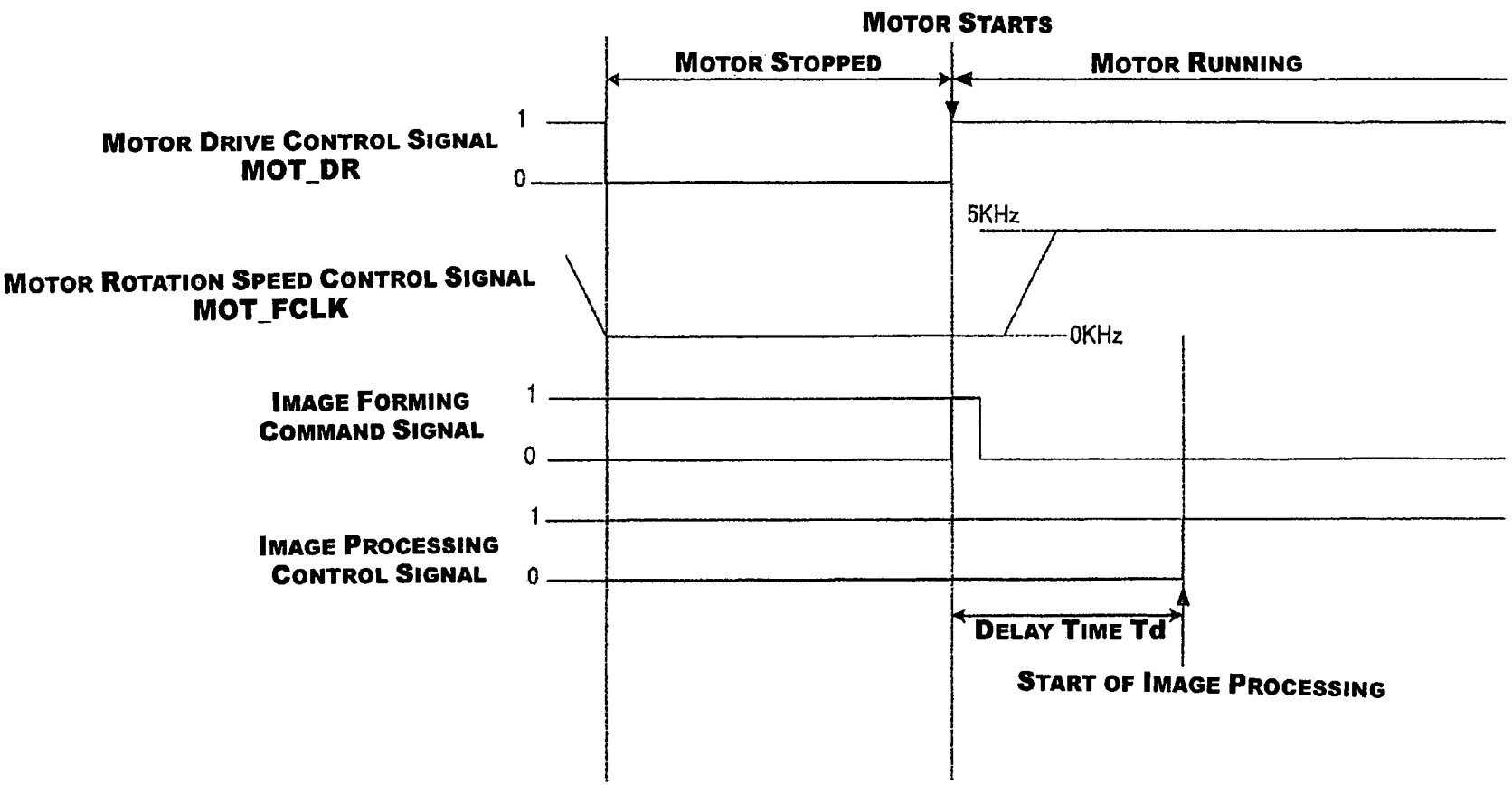
FIG. 6 is a view of a timing chart for the various signals of the drive device.

(4) Operation of the Motor Drive Control Unit and the Image Processing Control Unit FIG. 6 is a view of a timing chart for the motor drive control signal MOT_DR, the motor rotation speed control signal MOT_FCLK, the image forming command signal, and the image processing control signal. In FIG. 6, motor drive control signal MOT_DR is expressed by "0" for the motor stopped, and "1" for operating. The image processing control signal is expressed by "0" for OFF, and "1" for ON.

First, when the drive control unit 10 receives an external image forming command signal to start the image forming process, the drive control unit 10 switches the motor drive control signal MOT_DR from "0" to "1" and transmits the drive control signal MOT_DR to the motor 2. Next, the motor drive control unit 102 of the drive control unit 10 transmits a motor rotation speed control signal MOT_FCLK to the motor 2. In this way, the motor 2 rotates with a speed based on the motor rotation speed control signal MOT_FCLK.

Further, when the drive control unit 10 receives an external image forming command signal to start the image forming process, the temperature Te of the entire planetary roller type power transmission unit is obtained from the temperature sensor 5*b*. Then, the delay time determination unit 103 of the drive control unit 10 looks up the delay time conditions table 101*a* recorded in the recording unit 101 and determines the delay time Td based on the temperature Te. There is no particular limitation on the timing of determining the delay time Td based on the temperature Te by the delay time determination unit 103 or the timing of driving the motor 2 by the motor drive control unit 102. Either one may be carried out first.

The image processing control unit 104 starts to measure time from the start of the motor drive control signal MOT_DR, and transmits the image processing control signal "0" to the image forming unit 11 until the delay time Td has passed. When the delay time Td has passed, the image processing control unit 104 transmits the image processing control signal "1" to the image forming unit 11. During the delay time Td, the elastic deformation of the elastic material 4*a* of the planetary rollers 4 recovers.

(5) Effect

According to the drive device 1 of the present embodiment, recovery of the elastic deformation occurring in the elastic material 4*a* of the planetary rollers 4 while the motor 2 is stopped occurs during the delay time Td after the motor 2 has started, so the rotation speed of the output shaft 8 is constant. Therefore, it is possible to prevent phenomena such as color distortion and color unevenness on images as a result of non-uniformity of the rotation speed of the output shaft 8.

Furthermore, the drive device 1 determines the delay time Td based on the temperature of the entire planetary roller type power transmission unit that includes planetary rollers 4 made partly from an elastic material 4*a*. In this way, even when the time for recovery of the elastic deformation varies due to variations in the temperature of the elastic material 4*a* of the planetary rollers 4, it is possible for the drive device 1 to start the image forming process of the image forming unit 11 after the elastic deformation has recovered.

Second Embodiment

Figure 7:
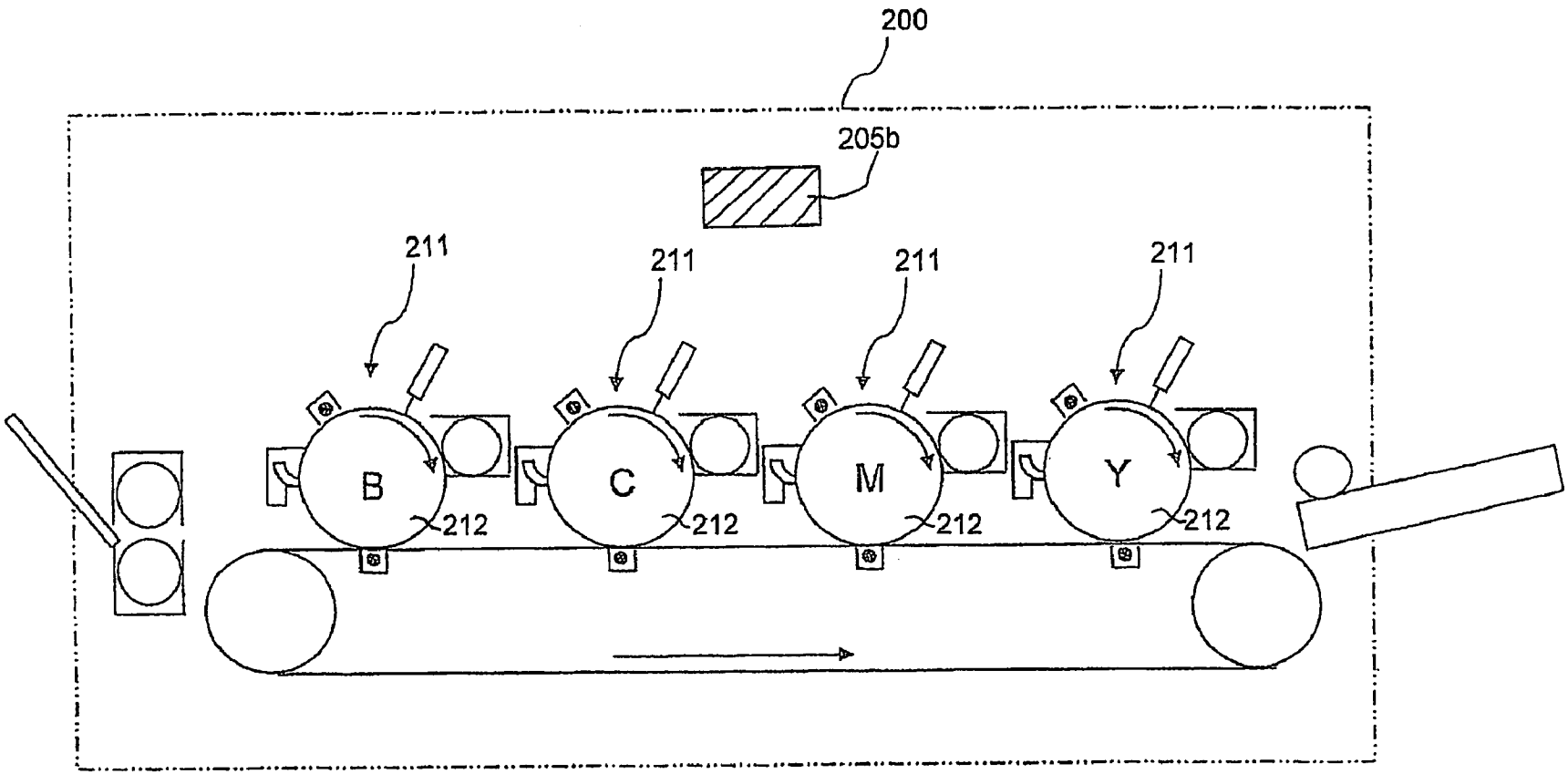
FIG. 7 is a schematic view of an image forming device according to a second preferred embodiment of the present invention.

Referring now to FIG. 7, a drive device used in an image forming device in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

In the present embodiment the temperature sensor 5*b* is provided within the drive device 1. However, as shown in FIG. 7, the temperature sensor 205*b* may be provided within the image forming device 200 having an image forming unit 211, or another suitable position, to measure the temperature of the entire image forming device 200. As shown in FIG. 1, if the temperature sensor 5*b* is provided within the drive device 1, the number of temperature sensors 5*b* required is the same as the number of drive devices 1 which are provided one per photosensitive drum 212. However, as shown in FIG. 7, if the temperature sensor 205*b* is provided for the entire image forming device 200, only one is necessary. Therefore the cost can be reduced.

Also, in the present embodiment, the delay time determination unit 103 determines the delay time Td based on the delay time conditions table 101*a*. However, the delay time Td may be determined based on a calculation formula for delay time that can determine a delay time Td that is independent of the temperature range.

The drive device according to the present invention can be used as the drive device for driving image forming unit in image forming devices such as color printers or color copiers.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming device equipped with the present invention. Accordingly, these terms, as utilized to describe the present invention should be interpreted relative to an image forming device equipped with the present invention as normally used. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A drive device comprising:

a planetary roller type power transmission unit having a motor having and being configured to rotate a motor rotation shaft, a plurality of planetary rollers having at least a part thereof made from an elastic material, said plurality of planetary rollers being pressed against the periphery of said motor rotation shaft, a ring being configured to contact said plurality of planetary rollers on an internal surface of said ring, a carrier roller being configured to rotate in conjunction with the rotation of said plurality of planetary rollers, and an output shaft being configured to output the rotation of said carrier roller to a driven device;

a measurement unit being configured to measure a temperature of said planetary rollers or a temperature near the planetary rollers;

a delay time determination unit being configured to determine a delay time from a starting time of said motor until a start of an image forming process based on the temperature measured by said measurement unit; and an image processing control unit being configured to start said image forming process after said delay time has passed from the starting time of said motor.

2. The drive device according to claim 1, further comprising a recording unit that records a plurality of temperature ranges and their corresponding conditions to determine said delay time, wherein said delay time determination unit determines the temperature range from among a plurality of temperature ranges in said recording unit that corresponds to the temperature measured by said measurement unit, and determines said delay time in accordance with the conditions corresponding to the applicable temperature range.

3. The drive device according to claim 1, further comprising a rotation speed sensor configured to measure a rotational speed of the carrier roller.

4. The drive device according to claim 3, further comprising a fixed body fixed to said motor, said fixed body configured to house said plurality of planetary rollers, said ring, said carrier roller, and said rotation speed sensor.

5. The drive device according to claim 1, further comprising a fixed body fixed to said motor, said fixed body configured to house said plurality of planetary rollers, said ring, and said carrier roller.

6. An image forming device comprising:

an image forming unit having at least one photosensitive drum;

a measurement unit being configured to measure temperature; and a drive device being configured to drive said photosensitive drum, said drive device having, a planetary roller type power transmission unit having a motor having and being configured to rotate a motor rotation shaft, a plurality of planetary rollers having at least a part thereof made from an elastic material, said plurality of planetary rollers being pressed against the periphery of said motor rotation shaft, a ring being configured to contact said plurality of planetary rollers on an internal surface of said ring, a carrier roller being configured to rotate in conjunction with the rotation of said plurality of planetary rollers, and an output shaft being configured to output the rotation of said carrier roller to a driven device, a delay time determination unit being configured to determine a delay time from a starting time of said motor until a start of an image forming process based on the temperature measured by said measurement unit, and an image processing control unit being configured to start said image forming process after said delay time has passed from the starting time of said motor.

7. The image forming device according to claim 6, further comprising a recording unit that records a plurality of temperature ranges and their corresponding conditions to determine said delay time, wherein said delay time determination unit determines the temperature range from among a plurality of temperature ranges in said recording unit that corresponds to the temperature measured by said measurement unit, and determines said delay time in accordance with the conditions corresponding to the applicable temperature range.

8. The image forming device according to claim 6, further comprising a rotation speed sensor configured to measure a rotational speed of the carrier roller.

9. The image forming device according to claim 8, further comprising a fixed body fixed to said motor, said fixed body configured to house said plurality of planetary rollers, said ring, said carrier roller, and said rotation speed sensor.

10. The image forming device according to claim 6, further comprising a fixed body fixed to said motor, said fixed body configured to house said plurality of planetary rollers, said ring, and said carrier roller.

11. The image forming device according to claim 6, wherein said measurement unit is arranged inside said drive device.

12. The image forming device according to claim 6, wherein said measurement unit is arranged outside said drive device.

* * * * *